US007650881B2

(12) United States Patent
Brown et al.

(10) Patent No.: US 7,650,881 B2
(45) Date of Patent: Jan. 26, 2010

(54) DOOR ASSEMBLY FOR A COOKING APPLIANCE

(75) Inventors: Justin T. Brown, Louisville, KY (US); Timothy Scott Shaffer, Louisville, KY (US); Christopher O'Malley, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/598,612

(22) Filed: Nov. 13, 2006

(65) Prior Publication Data

US 2008/0110449 A1 May 15, 2008

(51) Int. Cl.
*F23M 7/00* (2006.01)
*F24C 15/04* (2006.01)

(52) U.S. Cl. ..... 126/198; 126/21 R; 126/193

(58) Field of Classification Search ..... 126/198, 126/21 R, 193, 200; 219/391, 393, 400
See application file for complete search history.

(56) References Cited

U.S. PATENT DOCUMENTS

| | | | | | |
|---|---|---|---|---|---|
| 2,965,095 | A | | 12/1960 | Pearce et al. | |
| 3,509,868 | A | * | 5/1970 | Mono | 126/198 |
| 3,692,015 | A | * | 9/1972 | Chase et al. | 126/200 |
| 3,863,619 | A | * | 2/1975 | Wolf | 126/200 |
| 3,889,100 | A | * | 6/1975 | Dills | 219/393 |
| 3,924,601 | A | | 12/1975 | Nuss | |
| 4,180,049 | A | | 12/1979 | Carr et al. | |
| 4,241,718 | A | * | 12/1980 | Barnett | 126/21 R |
| 4,354,084 | A | * | 10/1982 | Husslein et al. | 219/757 |
| 4,390,767 | A | * | 6/1983 | Bucksbaum et al. | 219/740 |
| 5,193,520 | A | * | 3/1993 | Gostelow et al. | 126/21 A |
| 6,758,206 | B1 | * | 7/2004 | Barnes et al. | 126/21 R |
| 6,761,159 | B1 | * | 7/2004 | Barnes et al. | 126/21 R |

* cited by examiner

*Primary Examiner*—Kenneth B Rinehart
*Assistant Examiner*—Chuka C Ndubizu
(74) *Attorney, Agent, or Firm*—George L. Rideout, Esq.; Armstrong Teasdale LLP

(57) ABSTRACT

A door assembly for a cooking appliance including a cabinet, a lower oven cavity and an upper oven cavity defined within the cabinet is provided. The door assembly includes a lower oven door movably coupled to the cabinet and configured to cover the lower oven cavity. The lower oven door defines a lower oven door air inlet and a lower oven door air outlet. A lower oven door air passage is defined within the lower oven door and provides flow communication between the lower oven door air inlet and the lower oven door air outlet. An upper oven door is movably coupled to the cabinet and configured to cover the upper oven cavity. The upper oven door defines an upper oven door air inlet and an upper oven door air outlet. An upper oven door air passage is defined within the upper oven door and provides flow communication between the upper oven door air inlet and the upper oven door air outlet. The upper oven door air inlet is positioned with respect to the lower oven door air outlet such that air exiting the lower oven door air passage is directed into the upper oven door air passage.

20 Claims, 3 Drawing Sheets

DOOR ASSEMBLY FOR A COOKING APPLIANCE

BACKGROUND OF THE INVENTION

This invention relates generally to cooking appliances and, more particularly, to apparatus and methods for channeling air through doors of cooking appliances.

Many conventional cooking appliances include a cooktop including a plurality of heating elements positioned on a top surface of the cooktop, and a lower oven and an upper oven positioned below the cooktop. Each oven includes an oven cavity having at least one heating element positioned within the oven cavity, and an oven door configured to cover the oven cavity. It is desirable to maintain an outer surface of the oven door at a lower temperature than an inner surface of the oven door covering the oven cavity during operation.

At least some conventional cooking appliances include a first fan for channeling air through the lower oven door and a second fan for channeling air through the upper oven door to lower the outer surface temperature of the respective door. However, separately channeling air through the oven doors may not be effective in cooling the oven door outer surfaces to a desired temperature.

BRIEF DESCRIPTION OF THE INVENTION

In one aspect, a door assembly is provided for a cooking appliance including a cabinet, a lower oven cavity and an upper oven cavity defined within the cabinet. The door assembly includes a lower oven door movably coupled to the cabinet and configured to cover the lower oven cavity. The lower oven door defines a lower oven door air inlet and a lower oven door air outlet. A lower oven door air passage is defined within the lower oven door and provides flow communication between the lower oven door air inlet and the lower oven door air outlet. An upper oven door is movably coupled to the cabinet and configured to cover the upper oven cavity. The upper oven door defines an upper oven door air inlet and an upper oven door air outlet. An upper oven door air passage is defined within the upper oven door and provides flow communication between the upper oven door air inlet and the upper oven door air outlet. The upper oven door air inlet is positioned with respect to the lower oven door air outlet such that air exiting the lower oven door air passage is directed into the upper oven door air passage.

In another aspect, a cooking appliance is provided. The cooking appliance includes a cabinet. A lower oven cavity is defined within the cabinet and a lower oven door is movably coupled to the cabinet and configured to cover the lower oven cavity. The lower oven door includes a lower oven door air inlet and a lower oven door air outlet. A lower oven door air passage is defined within the lower oven door and provides flow communication between the lower oven door air inlet and the lower oven door air outlet. An upper oven cavity is defined within the cabinet and positioned above the lower oven cavity. An upper oven door is movably coupled to the cabinet and configured to cover the upper oven cavity. The upper oven door defines an upper oven door air inlet and an upper oven door air outlet. An upper oven door air passage is defined within the upper oven door and provides flow communication between the upper oven door air inlet and the upper oven door air outlet. The upper oven door air inlet is positioned with respect to the lower oven door air outlet such that air exiting the lower oven door air passage is directed into the upper oven door air passage.

In still another aspect, a method for cooling a cooking appliance is provided. The method includes providing a cabinet defining a lower oven cavity and an upper oven cavity. A lower oven door is movably coupled to the cabinet and configured to cover the lower oven cavity. The lower oven door defines a plurality of lower oven door air inlets, a plurality of lower oven door air outlets and a lower oven door air passage. The lower oven door air passage provides flow communication between the lower oven door air inlets and the lower oven door outlets. An upper oven door is movably coupled to the cabinet and configured to cover the upper oven cavity. The upper oven door defines a plurality of upper oven door air inlets, a plurality of upper oven door air outlets and an upper oven door air passage. The upper oven door air passage provides flow communication between the upper oven door air inlets and the upper oven air outlets. The upper oven door air inlets are positioned with respect to the lower oven door air outlets such that air exiting the lower oven door air passage is directed into the upper oven door air passage.

DETAILED DESCRIPTION OF THE INVENTION

Figure 1:
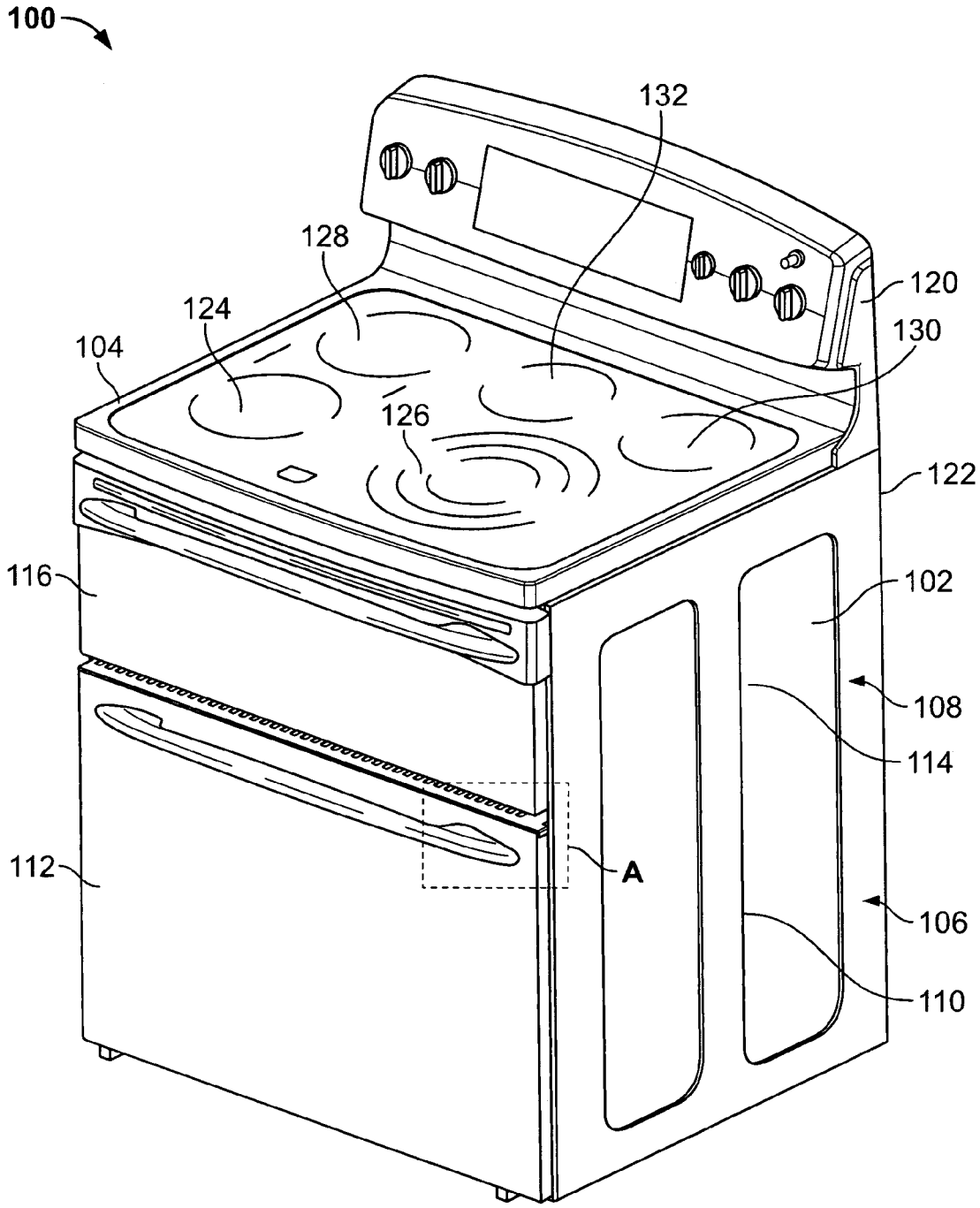
FIG. 1 is a perspective view of an exemplary cooking appliance.

FIG. 1 illustrates a cooking appliance in the form of a free standing range 100 including an outer body or cabinet 102 that incorporates a generally rectangular electrical cooktop 104. Range 100 includes a lower oven 106 positioned within cabinet 102 and an upper oven 108 positioned over lower oven 106 and within cabinet 102. Lower oven 106 defines a lower oven cavity 110. A front-access lower oven door 112 is configured to sealingly cover lower oven cavity 110. Similarly, upper oven 108 defines an upper oven cavity 114. A front-access upper oven door 116 is configured to sealingly cover upper oven cavity 114. A range backsplash 120 extends upward of a rear edge 122 of cooktop 104 and includes, for example, a control display and control selectors for user manipulation for facilitating selecting operative oven features, cooking timers, time and/or temperature displays.

Cooktop 104 includes a left front burner 124, a right front burner 126, a left rear burner 128, a right rear burner 130, and a center rear burner 132 positioned between burners 128 and 130. In one embodiment, burners 124, 128, 130, 132 are single element heaters, and burner 126 is a triple element heater capable of heating in different modes. It should be apparent to those skilled in the art and guided by the teachings herein provided that cooktop 104 may include any suitable number of heating elements, any suitable type of heating elements (i.e., single, double or triple element) and/or any suitable arrangement of the heating elements.

Further, it should be apparent to those skilled in the art and guided by the teachings herein provided that the present invention is applicable, not only to range 100 having an electrical cooktop, but also to any suitable cooking appliance including, without limitation, counter top cooking appliances, built-in cooking appliances and multiple fuel cooking appliances. Therefore, range 100 is provided by way of illustration rather than limitation, and accordingly there is no intention to limit application of the present invention to any particular appliance or cooktop, such as range 100 or cooktop 104.

Figure 2:
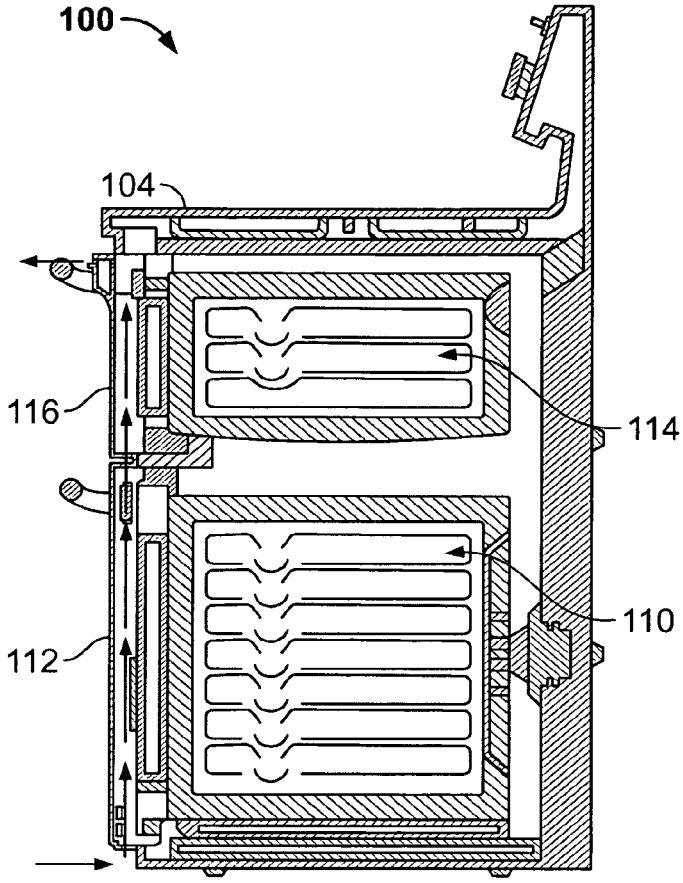
FIG. 2 is a cross-sectional view of the cooking appliance shown in FIG. 1.
Figure 3:
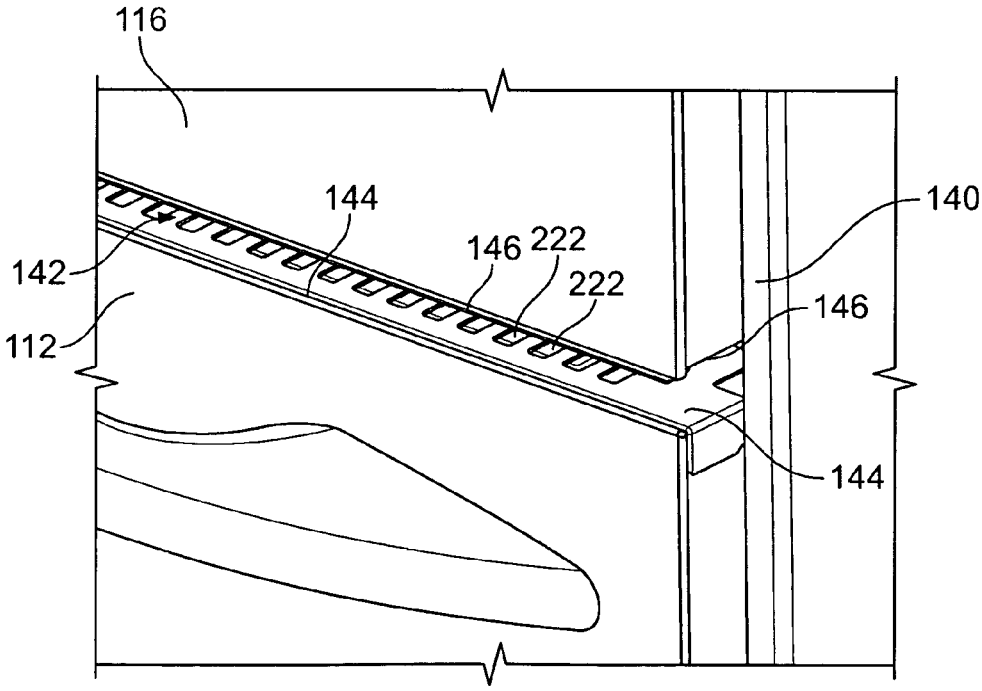
FIG. 3 is an enlarged view of portion A of the cooking appliance shown in FIG. 1.

FIG. 2 is a sectional view of range 100 shown in FIG. 1. FIG. 3 is an enlarged view of portion A of range 100 shown in FIG. 1. Oven doors 112, 116 are movably coupled to front side 140 of cabinet 102. In one embodiment, doors 112, 116 are coupled to front side 140 using a suitable hinge mechanism, such as a multiple fulcrum hinge that allows doors 112, 116 to translate as well as rotate or pivot during operation. In an alternative embodiment, door 112 and/or door 116 is movably coupled with respect to front side 140 using a suitable slide mechanism. It should be apparent to those skilled in the art and guided by the teachings herein provided that any suitable coupling, hinge or slide mechanism may be used to movably couple doors 112, 116 to front side 140. As shown in FIG. 3, a space or gap 142 is formed between a top edge portion 144 of lower over door 112 and a bottom edge portion 146 of upper oven door 116. Air flows upward through lower oven door 112 and upper oven door 116 for facilitating cooling a surface temperature of lower oven door 112 and/or upper oven door 116, as described in detail hereinafter.

Figure 4:
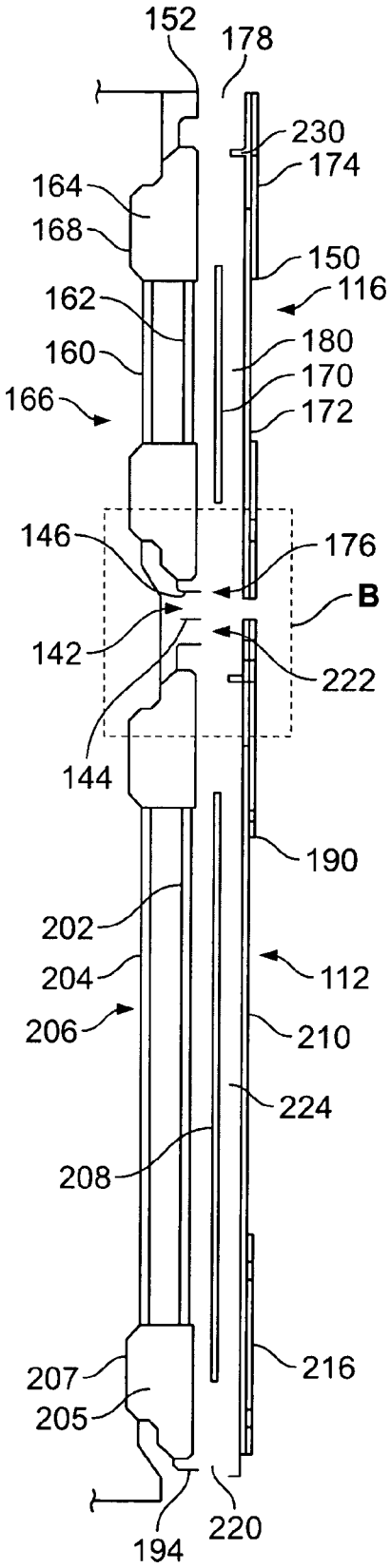
FIG. 4 is a cross-sectional view of exemplary doors suitable for use with the cooking appliance shown in FIG. 1.
Figure 5:
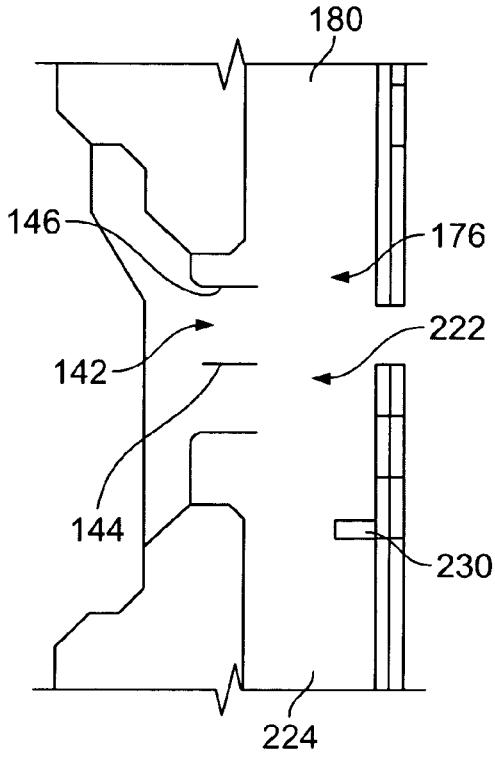
FIG. 5 is an enlarged view of portion B of the doors shown in FIG. 4.

FIG. 4 is a sectional view of an exemplary lower oven door 112 and upper oven door 116 suitable for use with range 100 shown in FIG. 1. FIG. 5 is an enlarged view of portion B of lower oven door 112 and upper oven door 116 shown in FIG. 4. In one embodiment, upper oven door 116 includes a front surface 150, and an top edge portion 152 and bottom edge portion 146 connecting with front surface 150 at opposite ends thereof. Upper oven door 116 also includes a first glass panel 160, a second glass panel 162 parallel to and spaced with respect to glass panel 160, and an upper oven door frame 164 surrounding first glass panel 160 and second glass panel 162. Glass panels 160, 162 are positioned adjacent corresponding upper oven cavity 114, and cooperatively form a window pack 166 for covering upper oven cavity 114. In this embodiment, a gasket 168 is attached to the inner surface of upper oven door frame 164, and is positioned between upper oven door frame 164 and upper oven cavity 114 with upper oven door 116 in a closed position, as shown in FIG. 2. As such, a gasket 168 facilitates sealing upper oven cavity 114 to facilitate maintaining a desired temperature within upper oven cavity 114.

Upper oven door 116 also includes a third or floating glass panel 170 positioned parallel to and outside window pack 166. A fourth or outer glass panel 172 is provided on front surface 150 of upper oven door 116, and is surrounded by a stainless steel wrap 174. Upper oven door 116 also includes at least one upper oven door air inlet 176 defined within bottom edge portion 146, and at least one upper oven door air outlet 178 defined within top edge portion 152. Outer glass panel 172 is spaced with respect to floating glass panel 170 and window pack 166 positioned inside glass panel 172. As such, an upper oven door air passage 180 is defined between window pack 166 and outer glass panel 172, and provides flow communication between air inlets 176 and air outlets 178. In one embodiment, upper oven door passage 180 is oriented substantially vertically with respect to upper oven door 116 and extends between air inlets 176 and air outlets 178.

In one embodiment, lower oven door 112 is similar to upper oven door 116 in structure, and is sized to cover lower oven cavity 110. In this embodiment, lower oven cavity 110 has a larger capacity than upper oven cavity 114 and, thus, lower oven door 112 is larger than upper oven door 116. Lower oven door 112 includes a front surface 190, top edge portion 144 and a bottom edge portion 194 connecting with front surface 190 at opposite ends thereof.

In one embodiment, lower oven door 112 includes a first glass panel 202, a second glass panel 204 substantially parallel to and positioned with respect to first glass panel 202 and a door frame 205 surrounding glass panels 202, 204. Glass panels 202, 204 are positioned adjacent corresponding lower oven cavity 110, and cooperatively form a window pack 206. In this embodiment, a gasket 207 is attached to the inner surface of lower oven door frame 205, and is positioned between lower oven door frame 205 and lower oven cavity 110 with lower oven door 112 in a closed position, as shown in FIG. 2. As such, gasket 207 facilitates sealing lower oven cavity 110 to facilitate maintaining a desired temperature within lover oven cavity 110.

In one embodiment, lower oven door 112 includes a third glass panel 208 and a fourth or outer glass panel 210 substantially parallel to and spaced with respect to each other. Lower oven door frame 205 surrounds glass panels 208 and 210. Further, in a particular embodiment, outer glass panel 210 is surrounded by a stainless steel wrap 216. At least one lower oven door air inlet 220 is defined within bottom edge portion 194 and at least one lower oven door air outlet 222 is defined within top edge portion 144. A lower oven door passage 224 is defined between window pack 206 and outer glass panel 210 to provide flow communication between air inlet 220 and air outlet 222. In one embodiment, a plurality of lower oven door air inlets 220 are arranged or spaced along bottom edge portion 194 and a plurality of lower oven door air outlets 222 are arranged or spaced along top edge portion 192. In this embodiment, lower oven door air passage 224 is configured to provide flow communication between lower oven door air inlets 220 and lower oven door air outlets 222.

Referring further to FIG. 3, bottom edge portion 146 of upper oven door 116 is substantially parallel to and generally opposes top edge portion 144 of lower oven door 112. In one embodiment, lower oven door air outlets 222 generally face upward and upper oven door air inlets 176 generally face downward such that lower oven door air outlets 222 are substantially aligned with upper oven door air inlets 176. As such, air exiting lower oven door air outlets 222 of lower oven door air passage 224 is directed to flow into upper oven door air passage 180. In this embodiment, lower oven door air passage 224 and upper oven door air passage 180 are oriented in a generally vertical orientation with respect to lower oven door 112 and upper oven door 116 for facilitating establishing a substantially linear or straight flow path through doors 112, 116. As such, air is directed to flow through lower oven door air passage 224 and upper oven door air passage 180 without being directed through a tortuous air flow path. The generally linear or straight air passage facilitates removing heat from the oven doors to cool the surface thereof. In alternative embodiments, the configuration and/or the arrangement of the air inlets, the air outlets and/or the air passages may be varied, as desired. Further, in an alternative embodiment, a cooling fan positioned with respect to lower oven door air passage 224 and/or upper oven door air passage 180 forces or directs air to flow through lower oven door air passage 224 and upper oven door air passage 180.

In one embodiment, two temperature probes or sensors 230 extend into upper oven door air passage 180 and lower oven door air passage 224, and are positioned adjacent corresponding air outlets 178, 222, respectively. Temperature sensors 230 detect and transmit the detected temperature to a controller (not shown) mounted on range backsplash 120 (shown in FIG. 1). As such, temperature sensors 230 facilitate detecting whether the surface temperature of lower oven door 112 and/or the surface temperature of upper oven door 116 are below a desirable temperature. In one embodiment, outer glass panel 172 of upper oven door 116 and/or outer glass panel 210 of lower oven door 112 are desirably maintained below a threshold temperature. Stainless stain wraps 174, 216 of upper oven door 116 and lower oven door 112, respectively, are also desirably maintained below a threshold temperature. In alternative embodiments, temperature sensor 230 may be removed or mounted at a different location with respect to lower oven door 112 and/or upper oven door 116.

Referring further to FIG. 4, in operation, when lower oven 106 and/or upper oven 108 are energized, such as for example, lower oven 106 or upper oven 108 is operated in a self-cleaning mode or lower oven 106 and upper oven 108 are operated in a baking mode, air is directed to flow upward through lower oven door 112 and upper oven door 116. In this embodiment, air flows into lower oven door air passage 224 through lower oven door air inlets 220 defined within bottom edge portion 194. The air is heated within lower oven door air passage 224 by the heated air within lower oven cavity 110 and then flows upward through lower oven door air passage 224 and exits through lower oven door air outlets 222. Upper oven door air inlets 176 are aligned with corresponding lower oven door air outlets 222 such that air exiting lower oven door air passage 224 substantially flows into upper oven door air passage 180. The heated air then flows through upper oven door air passage 180 and exits upper oven door 116 through upper oven door air outlets 178 defined within top edge 152. As such, a buoyancy-driven air flow is created through lower oven door 112 and upper oven door 116 and heat is removed from lower oven door 112 and/or upper oven door 116 by the air flow.

In one embodiment, air flows through the lower oven door and upper oven door for facilitating removing heat from the lower oven door and/or the upper oven door. Each of the lower oven door and the upper oven door include air inlets defined within a bottom edge portion and air outlets defined within the top edge portion, respectively, for facilitating providing a linear or straight flow path through the oven doors as well as providing an aesthetically pleasing appearance to the cooking appliance. In a particular embodiment, air flows through the oven doors due to buoyancy principles and, thus, a need for a fan to direct air flow through or across the oven door(s) is eliminated, resulting in a thinner oven door.

While the invention has been described in terms of various specific embodiments, those skilled in the art will recognize that the invention can be practiced with modification within the spirit and scope of the claims.

What is claimed is:

1. A door assembly for a cooking appliance comprising a cabinet and not including a fan, a lower oven cavity and an upper oven cavity defined within the cabinet, said door assembly comprising:

a lower oven door movably coupled to the cabinet and configured to cover the lower oven cavity, said lower oven door defining a lower oven door air inlet and a lower oven door air outlet, a lower oven door air passage defined within said lower oven door and providing flow communication between said lower oven door air inlet and said lower oven door air outlet; and an upper oven door movably coupled to the cabinet and configured to cover the upper oven cavity, said upper oven door defining an upper oven door air inlet and an upper oven door air outlet, an upper oven door air passage defined within said upper oven door and providing flow communication between said upper oven door air inlet and said upper oven door air outlet, said upper oven door air inlet positioned with respect to said lower oven door air outlet such that substantially all air exiting said lower oven door air passage is directed into said upper oven door air passage without use of a fan such that said upper oven door is cooled using natural convection.

2. A door assembly in accordance with claim 1 wherein said lower oven door air passage and said upper oven door air passage are configured to channel air along a substantially linear flow path.

3. A door assembly in accordance with claim 1 wherein said lower oven door air passage is aligned with said upper oven door air passage.

4. A door assembly in accordance with claim 1 wherein said lower oven door air passage and said upper oven door air passage are configured to channel a buoyancy driven air flow therethrough.

5. A door assembly in accordance with claim 1 wherein said lower oven door comprises a top edge portion at least partially defining said lower oven door air outlet and said upper oven door comprises a bottom edge portion at least partially defining said upper oven door air inlet.

6. A door assembly in accordance with claim 1 wherein said upper oven door air outlet is substantially facing upward.

7. A door assembly in accordance with claim 6 wherein said lower oven door air inlet is substantially facing downward.

8. A cooking appliance comprising:

a cabinet that does not include a fan;

a lower oven cavity defined within said cabinet;

a lower oven door movably coupled to said cabinet and configured to cover said lower oven cavity, said lower oven door comprising a lower oven door air inlet and a lower oven door air outlet, a lower oven door air passage defined within said lower oven door and providing flow communication between said lower oven door air inlet and said lower oven door air outlet;

an upper oven cavity defined within said cabinet and above said lower oven cavity; and an upper oven door movably coupled to said cabinet and configured to cover said upper oven cavity, said upper oven door defining an upper oven door air inlet and an upper oven door air outlet, an upper oven door air passage defined within said upper oven door and providing flow communication between said upper oven door air inlet and said upper oven door air outlet, said upper oven door air inlet positioned with respect to said lower oven door air outlet such that substantially all air exiting said lower oven door air passage is directed into said upper oven door air passage without use of a fan such that said unper oven door is cooled using natural convection.

9. A cooking appliance in accordance with claim 8 wherein said lower oven door air passage and said upper oven door air passage are configured to define a substantially linear flow path for channeling air from said lower oven door air passage through said upper oven door air passage.

10. A cooking appliance in accordance with claim 8 wherein said lower oven door air outlet is substantially aligned with said upper oven door air inlet.

11. A cooking appliance in accordance with claim 8 wherein said lower oven door air passage and said upper oven door air passage are configured to channel a buoyancy driven air flow therethrough.

12. A cooking appliance in accordance with claim 8 wherein said upper oven door comprises a bottom edge portion defining said upper oven door air inlet and said lower oven door comprises a top edge portion defining said lower oven door air outlet, said bottom edge portion substantially aligned with said top edge portion.

13. A cooking appliance in accordance with claim 8 wherein said upper oven door comprises a top edge portion defining said upper oven door air outlet.

14. A cooking appliance in accordance with claim 8 wherein said lower oven door comprises a bottom edge portion defining said lower oven door air inlet.

15. A method for cooling a cooking appliance, said method comprising:

providing a cabinet defining a lower oven cavity and an upper oven cavity, the cabinet not including a fan;

movably coupling a lower oven door to the cabinet configured to cover the lower oven cavity, the lower oven door defining a plurality of lower oven door air inlets, a plurality of lower oven door air outlets and a lower oven door air passage, the lower oven door air passage providing flow communication between the lower oven door air inlets and the lower oven door outlets; and movably coupling an upper oven door to the cabinet configured to cover the upper oven cavity, the upper oven door defining a plurality of upper oven door air inlets, a plurality of upper oven door air outlets and an upper oven door air passage, the upper oven door air passage providing flow communication between the upper oven door air inlets and the upper oven air outlets, the upper oven door air inlets positioned with respect to the lower oven door air outlets such that substantially all air exiting the lower oven door air passage is directed into the upper oven door air passage without operating a fan such that the upper oven door is cooled using natural convection.

16. A method in accordance with claim 15 further comprising configuring the lower oven door air passage and the upper oven door air passage to channel air along a substantially linear flow path.

17. A method in accordance with claim 15 further comprising aligning the lower oven door air outlets with corresponding upper oven door air inlets.

18. A method in accordance with claim 15 further comprising positioning the lower oven door air passage and the upper oven door air passage to channel buoyancy driven air flow through the lower oven door and the upper oven door.

19. A door assembly in accordance with claim 1 wherein said lower oven door air passage and said upper oven door air passage are configured to channel only a natural convection air flow therethrough.

20. A door assembly in accordance with claim 1 wherein said lower oven door air passage is defined between a first glass panel and an opposing second glass panel, said first glass panel and said second glass panel aligned substantially parallel to each other, and a third glass panel substantially parallel to said first glass panel and said second glass panel and positioned within said lower oven door air passage.

* * * * *